US009487727B2

(12) United States Patent
Meijer et al.

(10) Patent No.: US 9,487,727 B2
(45) Date of Patent: Nov. 8, 2016

(54) POLYMER THICKENED GREASE COMPOSITIONS WITH IMPROVED LOW FRICTION PROPERTIES

(75) Inventors: Dick Meijer, Wageningen (NL); Rihard Pasaribu, Nieuwegein (NL)

(73) Assignee: AKTIEBOLAGET SKF, Gothenburg (SE)

( * ) Notice: Subject to any disclaimer, the term of this patent is extended or adjusted under 35 U.S.C. 154(b) by 249 days.

(21) Appl. No.: 13/992,429

(22) PCT Filed: Dec. 8, 2011

(86) PCT No.: PCT/EP2011/072163

§ 371 (c)(1),
(2), (4) Date: Aug. 23, 2013

(87) PCT Pub. No.: WO2012/076638

PCT Pub. Date: Jun. 14, 2012

(65) Prior Publication Data

US 2013/0331307 A1 Dec. 12, 2013

(30) Foreign Application Priority Data

Dec. 9, 2010 (WO) ..... PCT/EP2010/007486

(51) Int. Cl.
*C10M 119/02* (2006.01)
*C10M 169/06* (2006.01)
*C10M 107/02* (2006.01)

(52) U.S. Cl.
CPC ..... *C10M 119/02* (2013.01); *C10M 169/06* (2013.01); *C10M 2205/0213* (2013.01); *C10M 2205/12* (2013.01); *C10M 2205/146* (2013.01); *C10M 2205/18* (2013.01); *C10N 2230/06* (2013.01); *C10N 2240/02* (2013.01); *C10N 2250/10* (2013.01)

(58) Field of Classification Search
CPC ..... C10M 119/02; C10M 169/06; C10M 2205/0213; C10M 2205/12; C10M 2205/146; C10M 2205/18; C10N 2230/06; C10N 2240/02; C10N 2250/10
USPC ..... 508/534, 591
See application file for complete search history.

(56) References Cited

U.S. PATENT DOCUMENTS

| | | | | |
|---|---|---|---|---|
| 3,392,119 | A | 7/1968 | Mitacek | |
| 3,850,828 | A | 11/1974 | Dodson | |
| 4,100,080 | A * | 7/1978 | Adams | 508/156 |
| 6,090,755 | A * | 7/2000 | Wan et al. | 508/108 |
| 2003/0069147 | A1 | 4/2003 | Kawamura | |
| 2007/0149422 | A1* | 6/2007 | Miyajima | C10M 159/06 508/451 |
| 2008/0176776 | A1* | 7/2008 | E. | C10M 169/06 508/376 |

FOREIGN PATENT DOCUMENTS

| | | | |
|---|---|---|---|
| EP | 0675192 | A1 | 10/1995 |
| EP | 0700986 | A2 | 3/1996 |
| EP | 700986 | A2 * | 3/1996 |
| EP | 0942063 | A1 | 9/1999 |
| JP | 2005112955 | A | 4/2005 |
| WO | 2010017909 | A1 | 2/2010 |

* cited by examiner

*Primary Examiner* — James Goloboy
(74) *Attorney, Agent, or Firm* — Bryan Peckjian; SKF USA Inc. Patent Dept.

(57) ABSTRACT

The invention provides a grease composition comprising:
(a) a lubricating base oil;
(b) a polymeric thickener comprising a mixture of (1) a (co- or homo)polymer of propylene with a weight average molecular weight of more than 200.000 and (2) a (co- or homo)polymer of propylene with a weight average molecular weight of less than 200.000; and
(c) a polar wax.

The invention further provides a mechanical component having a metal surface onto which a layer of the grease composition according to the invention has been applied. The invention also relates to the use of a polar wax in the preparation of a grease composition for bearing applications, and the use of a polar wax in a grease composition for bearing applications. In addition, the present invention relates to the use of the grease composition for reducing friction in a bearing, between bearing components or within a bearing application system. The invention also relates to a method for preparing the present grease composition.

19 Claims, No Drawings

POLYMER THICKENED GREASE COMPOSITIONS WITH IMPROVED LOW FRICTION PROPERTIES

CROSS-REFERENCE

This application is the US national stage of International Application No. PCT/EP2011/072163 filed on Dec. 8, 2011, which claims priority to the US national stage of International Application No. PCT/EP2010/007486 filed on Dec. 9, 2010, the contents of which are both herein fully incorporated by reference.

FIELD OF THE INVENTION

The present invention relates to a grease composition; a mechanical component onto which a layer of the grease composition has been applied; the use of the grease composition for bearing applications; the use of grease composition for reconditioning the lubrication of a mechanical component; the use of a polar wax in the preparation of a grease composition for bearing applications, the use of a polar wax in a grease composition for bearing applications; the use of the grease composition for reducing friction in a bearing, between bearing components or within a bearing application system; and a method for preparing the grease composition.

BACKGROUND OF THE INVENTION

Polymer thickened lubricating greases and their preparation are known in the art. In U.S. Pat. No. 3,392,119, a grease is described comprising a white mineral oil that has been thickened by means of a copolymer of ethylene and a homopolymer of polypropylene. In U.S. Pat. No. 3,850,828, a lubricating grease composition has been described which is thickened with a polymeric mixture comprising a polyethylene and an atactic polypropylene. In EP 0700986 A2, a polymeric thickener for lubricating grease compositions is disclosed comprising containing a mixture of copolymers or homopolymers of polypropylene having a high molecular weight and a copolymer or homopolymer of propylene having a low molecular weight. Further, In EP 0942063, a lubricating grease composition is described comprising at least one polyolefin component, at least one base oil component and at least one rubber component.

These known polymer thickened lubricating grease compositions still leave room for improvement in respect of friction reduction in various bearing applications.

SUMMARY OF THE INVENTION

Object of the present invention is to provide a new polymer thickened grease composition which displays an improved friction behaviour when compared to conventional grease compositions, including known polymer thickened grease compositions.

It has now been found that this can be established when a particular polymer thickened grease composition comprises a polar wax.

Accordingly, the present invention relates to a grease composition comprising:

(a) a lubricating base oil;

(b) a polymeric thickener comprising a mixture of (1) a (co- or homo)polymer of propylene with a weight average molecular weight of more than 200,000 and (2) a (co- or homo)polymer of propylene with a weight average molecular weight of less than 200,000; and (c) a polar wax.

The present grease composition displays excellent low friction behaviour composition.

DETAILED DESCRIPTION OF THE INVENTION

In the grease composition according to the present invention use is made of a polar wax. A polar wax is a wax which comprises a polar group in the wax components. Suitable polar waxes that can be used in accordance with the present invention include polyolefin waxes such as polar polypropylene wax , polar polyethylene wax, polar montan wax, polar derivatives of montan wax, such as esters, acids, fully saponified, partial saponified and emulisier containing esters. Preferably, the polar wax is a partially or fully saponified ester of a montanic acid, or an oxidized polyethylene wax. Montanic wax is obtainable from lignite or brown coal. Suitable waxes of a montanic acid derivative include esters of montanic acid. These montanic acid ester waxes may be partially or fully saponified. Specific examples of useful ester waxes from montanic acid to be used in accordance with the present invention include Licowax OM, Licowax OM FL and Licowax OP (as manufactured by Clariant Co.). Polar polyethylene waxes to be used in accordance with the present invention can suitably be prepared by oxidizing polyethylene wax or by oxidative decomposition of polymer grade polyethylene.

The polar polypropylene waxes to be used in accordance with the present invention can suitably be prepared by grafting polypropylene waxes with maleic anhydride.

Also, the grease composition according to the present invention comprises in addition a metal salt. The metal salt to be used in accordance with the present invention can be chosen from a wide variety of metals. Suitably, the metal of the metal salt is selected from the group consisting of Group 1A, 1B, 2A, 2B, 4A, 5A, 7B and 8B elements of the Periodic Table. Preferably, the metal in the metal salt is selected from the group consisting of bismuth, zinc, sodium, calcium, magnesium, antimony, barium, manganese, silver, gold, copper and lead. More preferably, the metal in the metal salt is bismuth, zinc or molybdenum. Even more preferably, the metal in the metal salt is bismuth or molybdenum. Most preferably, the metal in the metal salt is bismuth.

Suitably, the metal salt is selected from the group consisting of naphtenates, octoate, carbamate, carboxamides, sulfonamides, stearates, hydroxystearates and any mixture thereof. Preferably, the metal salt is a stearate, a hydroxystearate or a mixture thereof.

The polymer thickened grease to be used in accordance with the present invention comprises a polymeric thickener. In the present grease composition preferably only use is made of a polymeric thickener, not a conventional metal-based salt or metal-based soap thickener. However, a metal-based soap may be incorporated in the present grease composition as long as it does not adversely affect the overall properties of the grease composition.

It is observed that the metal salt to be used in accordance with the present invention does not act as a thickener. The metal salt to be used in accordance with the present invention is added to a grease composition that has already adequately been thickened by means of a polymer. The metal salt serves a different purpose, namely for lowering friction characteristics.

The present grease composition suitably comprising:

(a) 60-95 wt % of the lubricating base oil;

(b) 1-20 wt % of the polymeric thickener; and (c) 1-20 wt % of the polar wax, all weight percentages based on the total weight of the grease composition.

In case a metal salt is also present in the present grease composition, the grease composition suitably comprises:

(a) 60-95 wt % of the lubricating base oil;

(b) 1-20 wt % of the polymeric thickener; and (c) 1-20 wt % of the polar wax, (d) 1-20 wt % of the metal salt, all weight percentages based on the total weight of the grease composition.

The polymeric thickener to be used in the polymer thickened grease suitably comprises at least one component selected from the group consisting of natural rubber, synthetic rubber or rubber-like polymers, polypropylene, polyisoprene, polybutadiene, poly(styrene-butadiene), poly(ethylene-propylene-diene), polyurethane, polymethacrylate, polyisobutylene, poly(isobutylene-succinic acid), poly (isobutylene-succinic acid-polyacrylamide), polyurea and polyethylene.

The polymeric thickener to be used in accordance with the present invention comprises a first component and a second component, with the first component having a higher weight average molecular weight than the second component. The polymeric thickener comprises a high molecular weight component and a low molecular weight component, characterized in that the thickener comprises a mixture of (1) a (co- or homo-)polymer of propylene with a weight average molecular weight of more than 200,000 and (2) a (co- or homo-)polymer of propylene with a weight average molecular weight of less than 200,000.

Preferably, the polymeric thickener to be used in accordance with the present invention contains a high molecular weight component comprising a (co- or homo-)polymer of propylene with a weight average molecular weight in the range of from 200,000-350,000 and a low molecular weight component comprising a (co- or homo-) polymer of propylene with a weight average molecular weight in the range of from 20,000-200,000. Preferably, the low molecular weight component has a weight average molecular weight of less than 100,000, preferably in the range of from 50,000-100,000.

The weight ratio between the high molecular weight component and the low molecular weight component in the polymeric thickener can be in the range of from 1:40-3:1, suitably in the range of from 1:40-1:1, preferably in the range of from 1:40-1:5, more preferably in the range of from 1:25-1:15, and most preferably in the range of from 1:18-1:20. Outside this preferred range for the weight ratio between the high and low molecular weight components the final lubricating grease composition will generally not have desired application properties, in particular mechanical stability and consistency, i.e. be too "rubbery/elastic" and/or too "buttery". However, as the properties of the final composition are also dependent on the lubricant base oil and additives incorporated in grease compositions, as well as on the way the composition is prepared, other ratios may also be used for obtaining the desired properties of the final composition, as is well known to a man skilled in the art.

According to the present invention, the low molecular weight component is preferably a polypropylene homopolymer, more preferably a polypropylene homopolymer with a melt flow rate in the range of from of 500-1500 dg/min , especially in the range of from 750-1250 dg/min as determined by test ASTM D 1238 L.

The high molecular weight component preferably has a melt flow rate (ASTM D-1238) in the range of from 1.5-15, more preferably in the range of from 1.5-7, most preferably in the range of from 3-5.

The low molecular weight component is preferably a polypropylene homopolymer.

Preferably, the high molecular weight component is a polypropylene homopolymer or a propylene/ethylene-copolymer.

The polymer thickener according to the invention is suitably used in the lubricating grease composition in an amount in the range of from 1-20, preferably in the range of from 5-15, more preferably in the range of from 8-12 percent by weight of the total grease composition. Other amounts can be used if desired.

Apart from the polymeric thickeners mentioned in detail hereinabove, the present grease composition may also contain other polymeric thickeners.

As the lubricating base oil any lubricating oil known per se may be used, such as mineral oils, synthetic hydrocarbons, ester oils, vegetable oils and mixtures thereof, of different viscosity. The type of base oil and viscosity can be selected to suit specific applications.

Furthermore, additives known per se may be incorporated in the lubricant grease composition, as long as they do not have a detrimental effect on the thickener composition, the base oil and/or the final grease composition. The grease composition may additionally comprise at least one additive component which is selected from the group consisting of antioxidants, corrosion inhibitors, anti-wear agents and pressure tolerance-increasing additives, and wherein the total content of the additive component(s) is in the range of from 0.2-15% by weight, and preferably in the range of from 1-8% by weight, based on the total weight of the grease composition.

The present invention also relates to the use of a polar wax in a grease composition for bearing applications.

In addition, the present invention relates to the use of a grease composition according to the present invention for bearing applications.

The present invention also relates to the use of the grease composition according to to the present invention for reducing friction in a bearing, between bearing components or within a bearing application system.

In addition, the present invention relates to a method for preparing a grease composition according to the present invention comprising the following steps:

a) mixing the polymeric thickener with the base lubricating oil at a temperature higher than the melting point of the polymers used; and b) adding to the mixture obtained in step (a) the polar wax.

Suitably, during step (a) one or more anti-wear additives, anti-fretting additives, anti-corrosion additives, anti-oxidants and/or other additives are additionally mixed with the other components. If a metal salt is also present in the present grease composition, the metal salt will usually be additionally mixed with other components in step (a).

Suitably, the wax and, if present, metal salt are heated prior to mixing. In this way an improved homogenising effect can be established. Preferably, a final mixing is carried out in step (a) using a three-roll mill or a ball-mill.

The polymeric thickener composition according to the invention can be prepared by mixing the polymers in a manner known per se, which can optionally involve heating. The polymers of the subject invention are mixed with a lubricating base oil and optional additives by means of conventional techniques known per se resulting in the grease composition according to the invention.

The preparation of the grease composition is preferably be carried out under a protective atmosphere, such as a nitrogen gas flow, for avoiding oxidation of the oils during heating.

According to a preferred embodiment the solid polymeric components and the lubricating base oil are heated together (preferably under stirring) to a temperature above the melting point of polypropylene, preferably in the range of from 190-210° C., although other temperatures may be used if required.

After the polymers are dissolved in the lubricating base oil and optionally additives have been added, the grease is cooled from the mixing temperature to room temperature.

According to an especially preferred embodiment of the invention this cooling is carried out in a period of time in the range of from 1 sec.-3 min., preferably in the range of from 10 sec.-1 min., more preferably in the range of from 25-35 sec. This rapid cooling process, which forms an important aspect of the invention, will be indicated hereinbelow as "quenching". The quenching of the lubricant grease composition can be carried out, for instance, by pouring the grease composition on a metal plate, although any other suitable rapid cooling method may also be used, such as spraying.

The quenching process according to the invention has a major influence on the grease structure, giving significant improvement of the properties of the final grease compositions compared to both conventional lubricating greases, as well as lubricating greases according to the invention which are cooled slowly, e.g. in approximately 1 degree per minute by the use of conventional cooling methods, such as simply keeping the grease in the reaction vessel with external/internal cooling. This results, for the polymer grease, in a lubricant lacking any mechanical stability.

In the grease composition according to the invention, the polymeric thickener forms a sponge-like structure, which gives the grease its appearance and structure. The lubricating base oil is kept within the pore-like spaces within the thickener structure, and bleeds out during service of the grease. The thickener-structure is very irregular with large pores as well as very small pores. The above indicated quenching of the lubricant grease composition provides a grease according to the invention with a smoother and more uniform structure of the polymeric thickener, with more uniformly distributed spaces for keeping the lubricant oil.

During service of the lubricant grease, the oil bleeds out of the oil/thickener-structure onto the surfaces of the bearing, thereby providing the lubricating action. The oil bleeding characteristics at the service temperature of the lubricant grease composition (i.e. the running temperature of the bearing, as well as the "start up" temperature) are therefore critical for obtaining the lubricating action of the composition.

The mechanical stability of the grease is dependent on the polymer thickener used, the lubricating base oil used, as well as the additives used. Further, the mechanical properties of the grease can be influenced by "working" the grease after the thickener is mixed with the lubricating base oil, as is well known to a man skilled in the art of lubricants.

Preferably, the grease is "worked" to a consistency desired and/or required for its intended use.

The mechanical stability of the grease can be ascertained by means of tests known in the art, such as the Shell roll stability test. Preferably, the grease will have a penetration after the Shell roll stability test (24 hrs at 80° C., 165 rpm), of max. 360.

The consistency of the grease can be classified by means of the NLGI-class. According to the present invention the grease can usually be prepared to a NLGI-class range 0 to 4. Also, the viscosity of the separated oil must be acceptable, and preferably be constant.

The polymer-thickened grease composition according to the present invention can be used for all conventional applications for lubricant grease compositions, so long as these are compatible with the components of the lubricant grease composition. The present grease composition can be used for lubricating bearings, couplings, toothed transmission gears, chutes or other instruments.

The mechanical component having a metal surface to be treated with the grease composition according to the present invention is preferably a bearing, bearing component or a bearing application system. The bearing component may be inner rings, outer rings, cages, rollers, balls and seal-counter faces. The bearing application system in accordance with the present invention comprises bearing housings, mounting axles, shafts, bearing joints and shields.

The present invention further relates to a grease composition obtainable according to the method of the invention.

The grease composition in accordance with the present invention may have the form of a lubricant composition having an oily character or a paste, depending on the viscosity of the final grease composition.

The invention will now be further illustrated by the following Examples, which do not limit the invention in any way.

EXAMPLES

Example 1

A number of greases were used in a reciprocating sliding test. The grease compositions used in these test experiments are shown in Table 1. The reciprocating sliding test was carried out under the following conditions:

Configuration: hardened steel ball on hardened steel flat surface
Roughness of the ball (Ra): 10 nm
Roughness of flat surface (RA): 20 nm
Ball diameter: 6 mm
Normal load: 3.5 N (1 GPa Hertzian pressure)
Temperature: 60° C.
Stroke: 4 mm, 0.5 Hz The results of these tests experiments in terms of coefficients of friction are shown in Table 2. From the test results shown in Table 2 it is evident that experiment No 1 wherein use of the grease composition according to the present invention shows a considerably improved low friction performance when compared with experiments 2-5 wherein use is made of conventional greases.

TABLE 1

| Grease composition | Composition of grease |
|---|---|
| Grease No. 1* | 11% polypropylene, 84% PAO base lubricating oil, 5% wax of partially saponified ester of montanic acid (Clariant - Licowax OMFL) |
| Grease No. 2* | 11% polypropylene, 89% PAO base lubricating oil |
| Grease No. 3** | SKF GHG (metal-based soap thickener in a mineral base oil) |
| Grease No. 4** | Kyodo Yushi, Raremax AF-1 (polyurea thickener in a mineral base oil) |

TABLE 1-continued

| Grease composition | Composition of grease |
|---|---|
| Grease No. 5** | ESSO/Mobil, Infinitec 152 (metal-based soap thickener in poly alpha olefin base (PAO) oil) |

*PAO (poly alpha olefin)
**commercially available grease

TABLE 2

| Experiment No. | Grease composition | Coefficient of Friction |
|---|---|---|
| Experiment No. 1 | Grease No. 1 | 0.055 |
| Experiment No. 2 | Grease No. 2 | 0.08 |
| Experiment No. 3 | Grease No. 3 | 0.1 |
| Experiment No. 4 | Grease No. 4 | 0.09 |
| Experiment No. 5 | Grease No. 5 | 0.11 |

Example 2

In this example greases Nos. 1-5 were subjected to a ball-on-disk test which was carried out under the following conditions.

Load: 300 N (1.9 GPa Hertzian pressure)
Disk: 100Cr6 cicrular ground; Ra 0.1 μm; Rq 0.14 μm
Ball: RB 20.638 G10
Slide to roll ratio: 5%
Constant entrainment speed: 0.05 m/s; 1.0 m/s.
Temperature: 40°

The test results are shown in Table 3. From Table 3 it is clear that experiment No. 6 wherein use is made of a grease in accordance with the present invention displays a significantly improved low friction behaviour when compared with experiments 7-10 wherein use is made of conventional greases.

TABLE 3

| Experiment No. | Grease composition | Coefficient of Friction (constant entrainment speed 0.05 m/s) | Coefficient of Friction (constant entrainment speed 1.0 m/s) |
|---|---|---|---|
| Experiment No. 6 | Grease No. 1 | 0.03 | 0.035 |
| Experiment No. 7 | Grease No. 2 | 0.07 | 0.06 |
| Experiment No. 8 | Grease No. 3 | 0.055 | 0.07 |
| Experiment No. 9 | Grease No. 4 | 0.065 | 0.075 |
| Experiment No. 10 | Grease No. 5 | 0.06 | 0.07 |

Example 3

A number of greases were used in a reciprocating sliding test. The grease compositions used in these test experiments are shown in Table 4. The reciprocating sliding test was carried out under the following conditions:

Configuration: hardened steel ball on flat surface polyoxymethylene surface
Roughness of the ball (Ra): 10 nm
Roughness of flat surface (RA): 20 nm
Ball diameter: 6 mm
Normal load: 3.4 N (1 GPa Hertzian pressure)
Temperature: 60° C.
Stroke: 4 mm, 0.5 Hz The results of these tests experiments in terms of coefficients of friction are shown in Table 5. From the test results shown in Table 5 it is evident that experiment Nos. 11 and 12 wherein use of the grease composition according to the present invention show a considerably improved low friction performance when compared with experiment No. 13 wherein use is made of conventional grease.

TABLE 4

| Grease composition | Composition of grease |
|---|---|
| Grease No. 11* | 11% polypropylene, 79% PAO base lubricating oil, 5% wax of partially saponified ester of montanic acid (Clariant - Licowax OMFL), 5% bismuth hydroxystearate |
| Grease No. 12* | 6% polypropylene, 74% PAO base lubricating oil, 5% oxidized polyethylene was (Licowax PED 121), 5% wax of partially saponified ester of montanic acid (Clariant - Licowax OMFL), 5% bismuth hydroxylstearate |
| Grease No. 13* | 11% polypropylene, 89% PAO base lubricating oil |

*PAO (poly alpha olefin)

TABLE 5

| Experiment No. | Grease composition | Coefficient of Friction | Friction reduction (%) when compared to Exp. No. 13 |
|---|---|---|---|
| Experiment No. 11 | Grease No. 11 | 0.022 | 35 |
| Experiment No. 12 | Grease No. 12 | 0.015 | 55 |
| Experiment No. 13 | Grease No. 13 | 0.034 | — |

Example 4

A number of greases were used in a reciprocating sliding test. The grease compositions used in these test experiments are shown in Table 6. The reciprocating sliding test was carried out under the following conditions:

Configuration: hardened steel ball on on hardened steel flat surface
Roughness of the ball (Ra): 10 nm
Roughness of flat surface (RA): 20 nm
Ball diameter: 6 mm
Normal load: 3.4 N (1 GPa Hertzian pressure)
Temperature: 60° C.
Stroke: 4 mm, 0.5 Hz The results of these tests experiments in terms of coefficients of friction are shown in Table 7. From the test results shown in Table 5 it is evident that experiment No. 14-17 wherein use of the grease composition according to the present invention show a considerably improved low friction performance when compared with experiment No. 18 wherein use is made of conventional grease.

TABLE 6

| Grease composition | Composition of grease |
|---|---|
| Grease No. 14* | 11% polypropylene, 84% PAO base lubricating oil, 5% wax of partially saponified ester of montanic acid (Clariant - Licowax OMFL) |
| Grease No. 15* | 11% polypropylene, 84% PAO base lubricating oil, 5% bismuth hydroxystearate |
| Grease No. 16* | 11% polypropylene, 79% PAO base lubricating oil, 10% oxidized polyethylene wax (Licowax PED 121) |

TABLE 6-continued

| Grease composition | Composition of grease |
|---|---|
| Grease No. 17* | 11% polypropylene, 79% PAO base lubricating oil, 5% wax of partially saponified ester of montanic acid (Clariant - Licowax OMFL), 5% bismuth hydroxystearate |
| Grease No. 18* | 11% polypropylene, 89% PAO base lubricating |

*PAO (poly alpha olefin)

TABLE 7

| Experiment No. | Grease composition | Coefficient of Friction | Friction reduction (%) when compared to Exp. No. 18 |
|---|---|---|---|
| Experiment No. 14 | Grease No. 14 | 0.053 | 29 |
| Experiment No. 15 | Grease No. 15 | 0.058 | 23 |
| Experiment No. 16 | Grease No. 16 | 0.055 | 27 |
| Experiment No. 17 | Grease No. 17 | 0.052 | 31 |
| Experiment No. 18 | Grease No. 18 | 0.075 | — |

The invention claimed is:

1. A grease composition comprising:

(a) 74-79 wt % of a poly alpha olefin lubricating base oil;

(b) 6-11 wt % of a polymeric thickener comprising a mixture of (1) a (co- or homo)polymer of propylene with a weight average molecular weight of more than 200,000 and (2) a (co- or homo)polymer of propylene with a weight average molecular weight of less than 200,000; and (c) 5-10 wt % of a polar polypropylene wax, wherein all weight percentages are based on the total weight of the grease composition.

2. The grease composition according to claim 1, wherein the weight ratio between the high molecular weight component and the low molecular weight component is 1:40-1:5.

3. The grease composition according to claim 2, wherein the low molecular weight component is a polypropylene homopolymer.

4. The grease composition according to claim 3, wherein the low molecular weight component has an average molecular weight between 20,000 and 200,000 and a melt flow rate of 500-1500 dg/min.

5. The grease composition according to claim 4, wherein the high molecular weight component is a polypropylene homopolymer or a propylene/ethylene-copolymer.

6. The grease composition according to claim 5, wherein the high molecular weight component has an average molecular weight of 200,000-350,000 and a melt flow rate of 1.5-15 dg/min.

7. The grease composition according to claim 1, further comprising a metal salt which is selected from the group consisting of stearates, hydroxystearates and any mixture thereof.

8. The grease composition according to claim 7, wherein the metal of the metal salt is bismuth.

9. The grease composition according to claim 8, which further comprising:

at least one additive component which is selected from the group consisting of antioxidants, corrosion inhibitors, anti-wear agents and pressure tolerance-increasing additives, and wherein the total content of the additive component(s) is in the range between 0.2 and 15% by weight, based on the total weight of the grease composition.

10. A method for preparing a grease composition comprising:

(a) 74-79 wt % of a poly alpha olefin lubricating base oil;

(b) 6-11 wt % of a polymeric thickener comprising a mixture of (1) a (co- or homo)polymer of propylene with a weight avenge molecular weight of more than 200,000 and (2) a (co- or homo)polymer of propylene with a weight average molecular weight of less than 200,000; and (c) 5-10 wt % of a polar polypropylene wax, wherein all weight percentages are based on the total weight of the grease composition, the method comprising the following steps:

a) providing the poly alpha olefin lubricating base oil; polymeric thickener, and the polar wax;

b) mixing the polymeric thickener with the poly alpha olefin lubricating oil at a temperature higher than the melting point of the polymers used;

c) adding the polar polypropylene wax to the mixture obtained in step (b).

11. The method according to claim 10 comprising additionally mixing during step (b) one or more anti-wear additives, anti-corrosion additives, anti-oxidants and/or other additives.

12. The method according to 11, wherein a final mixing in step (b) is carried out using a three-roll mill or ball-mill.

13. The method according to claim 11, further comprising using a polar wax in the preparation of the grease composition for reducing friction in a bearing, between bearing components or within a bearing application system.

14. The grease composition according to claim 1, wherein the weight ratio between the high molecular weight component and the low molecular weight component is 1:25-1:15.

15. The grease composition according to claim 1, wherein the weight ratio between the high molecular weight component and the low molecular weight component is 1:18-1:20.

16. The grease composition according to claim 3, wherein the low molecular weight component has an average molecular weight between 20,000 and 200,000 and a melt flow rate of 750-1250 dg/min.

17. The grease composition according to claim 5, wherein the high molecular weight component has an average molecular weight of 200,000-350,000 and a melt flow rate of 1.5-7.

18. The grease composition according to claim 9, wherein the total content of at least one additive component is in the range of between 1 and 8% by weight based on the total weight of the grease composition.

19. The grease composition according to claim 1, wherein the grease composition has a coefficient of friction of between 0.015 and 0.058 as measured using a reciprocating sliding test at 60° C. with a stroke length of 4 mm at a frequency of 0.5 Hz and a normal load of 3.4 N.

* * * * *